US006807793B1

(12) United States Patent
Romagnoli

(10) Patent No.: US 6,807,793 B1
(45) Date of Patent: Oct. 26, 2004

(54) APPARATUS FOR PREPARING AND FEEDING THE MATERIALS USED TO MAKE A FILTER BAG FOR INFUSION PRODUCTS

(75) Inventor: Andrea Romagnoli, San Lazzaro di Savena (IT)

(73) Assignee: Tecnomeccanica S.r.l., Bologna (IT)

( * ) Notice: Subject to any disclaimer, the term of this patent is extended or adjusted under 35 U.S.C. 154(b) by 0 days.

(21) Appl. No.: 10/620,974

(22) Filed: Jul. 16, 2003

(30) Foreign Application Priority Data

Jul. 23, 2002 (IT) ..... BO2002A0477

(51) Int. Cl.[7] ..... B65B 61/14
(52) U.S. Cl. ..... 53/134.2; 53/133.5; 493/375
(58) Field of Search ..... 53/134.2, 133.5; 493/374, 375, 379

(56) References Cited

U.S. PATENT DOCUMENTS 3,566,573 A * 3/1971 Irmscher ..... 53/397
4,977,728 A * 12/1990 Rambold ..... 53/567
5,580,408 A 12/1996 Vernon et al.
5,870,880 A * 2/1999 Romagnoli ..... 53/134.2
6,216,620 B1 * 4/2001 Shepard ..... 112/475.17
6,453,639 B1 * 9/2002 Sgubbi ..... 53/134.2
6,711,876 B1 * 3/2004 Benedetti ..... 53/134.2
6,725,628 B2 * 4/2004 Lohrey et al. ..... 53/413

FOREIGN PATENT DOCUMENTS

DE 12 29 895 B 12/1966
IT BO2002A000013 1/2002

OTHER PUBLICATIONS

European Search Report pertaining to EP Application No. 03 42 5471.

* cited by examiner

*Primary Examiner*—Eugene Kim
(74) *Attorney, Agent, or Firm*—Fay, Sharpe, Fagan, Minnich & McKee, LLP

(57) ABSTRACT

An apparatus for preparing and feeding materials used to make a filter bag for infusion products includes a revolving wheel having mechanisms arranged in succession thereon that are used for: forming filter bag pick-up tags and arranging them in order; feeding a continuous thread and forming first loops in the thread at regular intervals; delimiting separate faces on the tags and folding them onto each other so that the loops are held therebetween; joining the faces of each tag to each other; associating a web of filter paper to the edge of the revolving wheel and positioning it above the continuous thread and the tags connected to the thread; pushing a portion of the thread through the filter paper so as to form a second loop extending outward from the wheel.

17 Claims, 6 Drawing Sheets

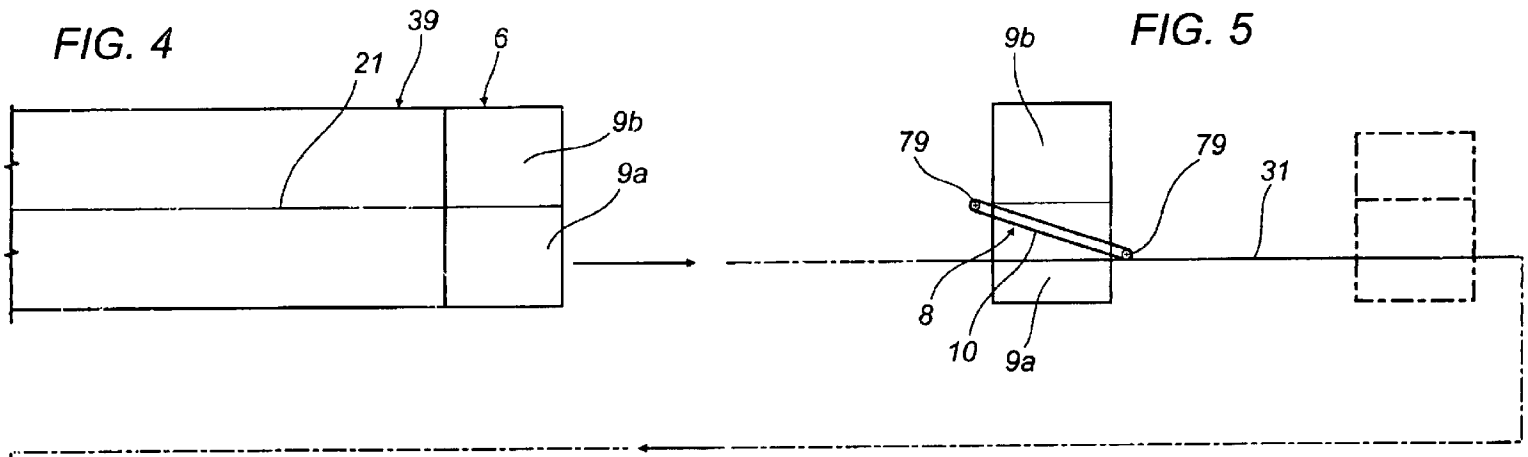
FIG. 4
FIG. 5
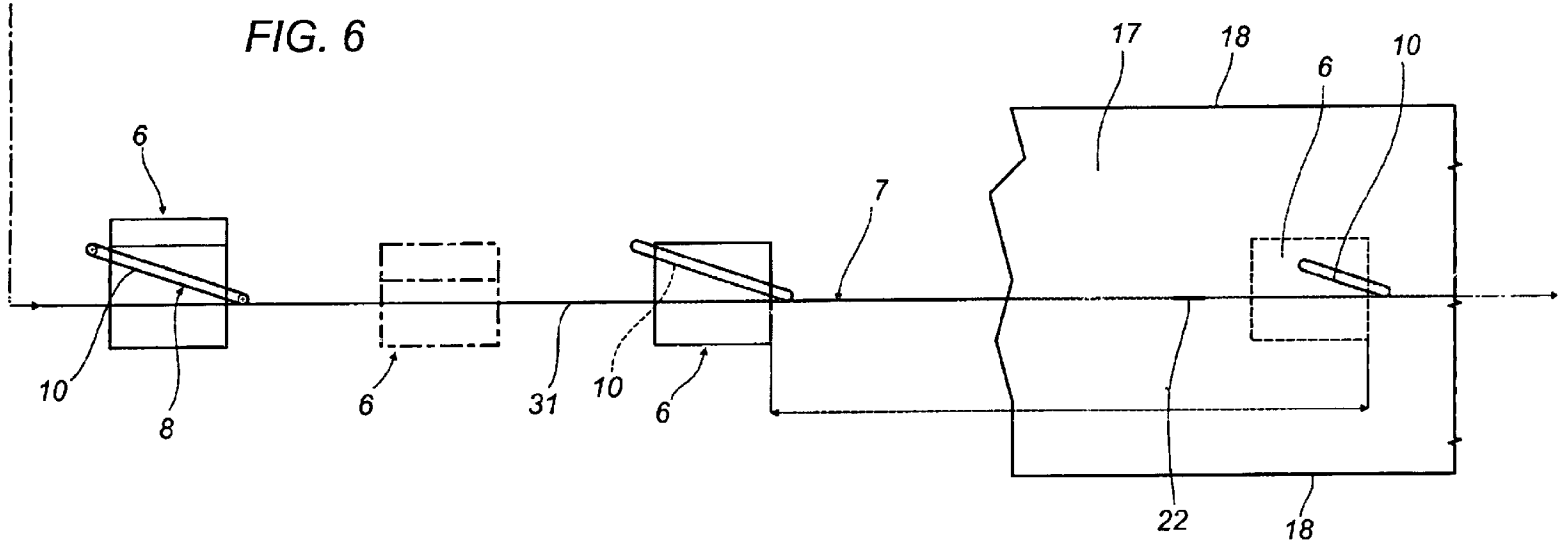
FIG. 6

APPARATUS FOR PREPARING AND FEEDING THE MATERIALS USED TO MAKE A FILTER BAG FOR INFUSION PRODUCTS

BACKGROUND OF THE INVENTION

The present invention relates to the automatic production of filter paper bags containing infusion products such as tea, chamomile and similar herbs designed to be immersed in a liquid in order to make infusions.

In particular, the invention relates to an apparatus for preparing and feeding materials used to make the filter bags and is designed to be advantageously fitted to an automatic production machine.

In the automatic production of filter bags for infusion products, prior art teaches the use of filter paper bags with twin-pouch containment chamber, also known as "two-lobed filter bags", made by heat-sealing, that is to say, by suitably folding the filter paper and then sealing it along the folds by thermally activating a layer of glue spread on the web of filter paper during the original filter paper manufacturing process.

Bags made of heat-sealable filter paper are normally heavier than bags of the same size and shape in which the containment chambers which hold the charges of product are made by folding alone.

Since the cost of the paper is proportional to its weight, the greater weight of the bags made of heat-sealable filter paper means that, all other conditions being equal, they are more expensive than those made using folding alone. To make bags made of heat-sealable paper economically competitive with bags made by folding alone, it is common practice to give the bags made of heat-sealable paper smaller overall dimensions than those of the corresponding bags made of folded paper.

This leads to another problem, well known in the field of automatic machinery for making this type of product and that is, how, during the entire production process, to arrange and control the thread connecting the tag to the chambers that contain the infusion product.

In some types of filter bags, this problem has been solved by winding the length of thread around the containment chamber and securing it in this position. In such cases, however, the thread is precisely as long as the outline of the filter bag and, if the filter bag is made of heat-sealable paper, the smaller size of the filter bag means that the working length of the thread available is shorter.

Thus, if the infusion is prepared in certain types of tea-pots or in particularly tall cups or glasses, the thread length may be insufficient to prevent the tag from accidentally slipping over the edge of the infusion container during infusion and falling into the infusion liquid, with obvious consequences in terms of hygiene and/or pick-up tag recovery.

To overcome this drawback, patent document IT BO 2002A000013, in the name of the same Applicant as the present, proposes a filter bag and a method for making it, where the length of the thread is completely independent of the length of the outline of the filter bag containment chamber. More specifically, the thread is considerably longer than the outline of the filter bag.

The longer thread which, if left uncontrolled, would create serious problems for the automatic production process, is associated with a tag—in particular a twin-flap tag—and a portion of it is gathered and held between the flaps of the tag.

This solution, however, inevitably involves the need to provide suitable means especially adapted to implement a method for producing filter bags of this type on an industrial scale.

In this context, a highly critical role is that of preparing, reciprocally associating and feeding the materials used to make the filter bags prior to actually forming the containment chambers and placing the charges of infusion product in them.

The present invention has for an aim to solve the above mentioned problems through an apparatus that is capable of operating at high speeds; that is reliable; and that, at the same time, has a relatively simple and economical structure.

SUMMARY OF THE INVENTION

In accordance with the invention, these results are achieved by an apparatus for preparing and feeding materials used to make filter bags to contain an infusion product, the apparatus comprising the following arranged in succession around the edge of a power-driven revolving wheel:

first means for forming filter bag pick-up tags from a web of suitable material and arranging them in suitable order around the edge of the revolving wheel;

second means for feeding a continuous thread and forming in it first loops at regular intervals from each other at positions corresponding to the tags carried by the revolving wheel;

third means acting on the tags for delimiting separate faces on each tag and folding these faces onto each other in such a way that the first loops of thread are held between the tag faces;

fourth means for joining the faces of each tag to each other;

fifth means for associating a web of filter paper to the edge of the revolving wheel and positioning it above the continuous thread and the tags connected to it;

sixth means associated with the revolving wheel for pushing a portion of the continuous thread stretched on the edge of the wheel through the web of filter paper in such a way as to form a second loop extending outwards from the wheel and protruding from the face of the filter paper web opposite the face adjoining the tags.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

FIGS. 4 to 7 schematically represent several significant steps in the method for making the filter bag of FIG. 1;

DESCRIPTION OF THE PREFERRED EMBODIMENTS

Figure 1:
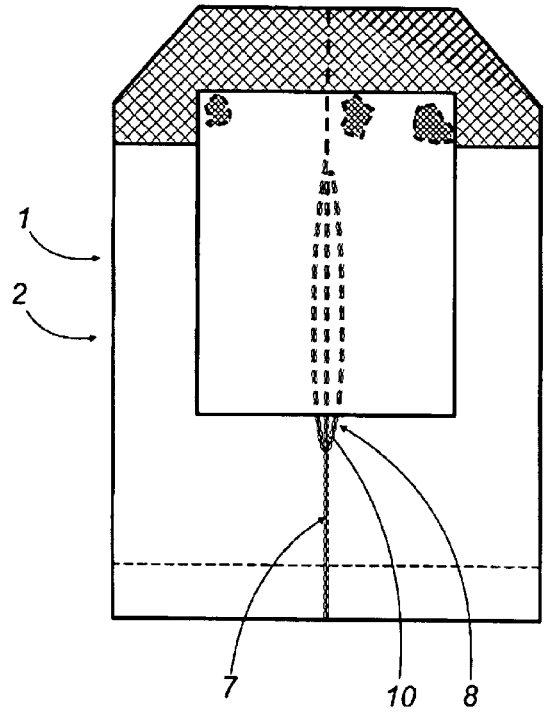
FIGS. 1, 2 and 3 are, respectively, a side assembly view, a front view and a scaled-up detail view of a filter bag of the type known from document BO2002A000013.
Figure 2:
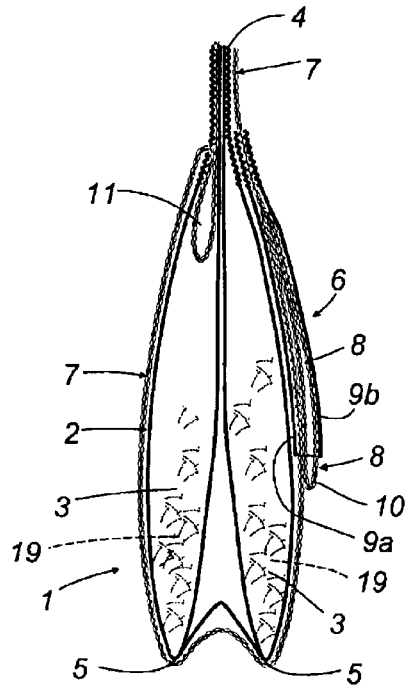
Figure 3:
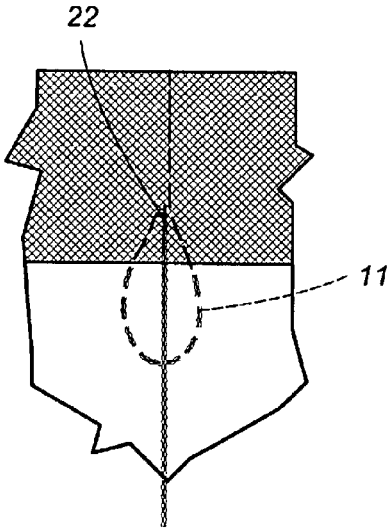
Figure 7:
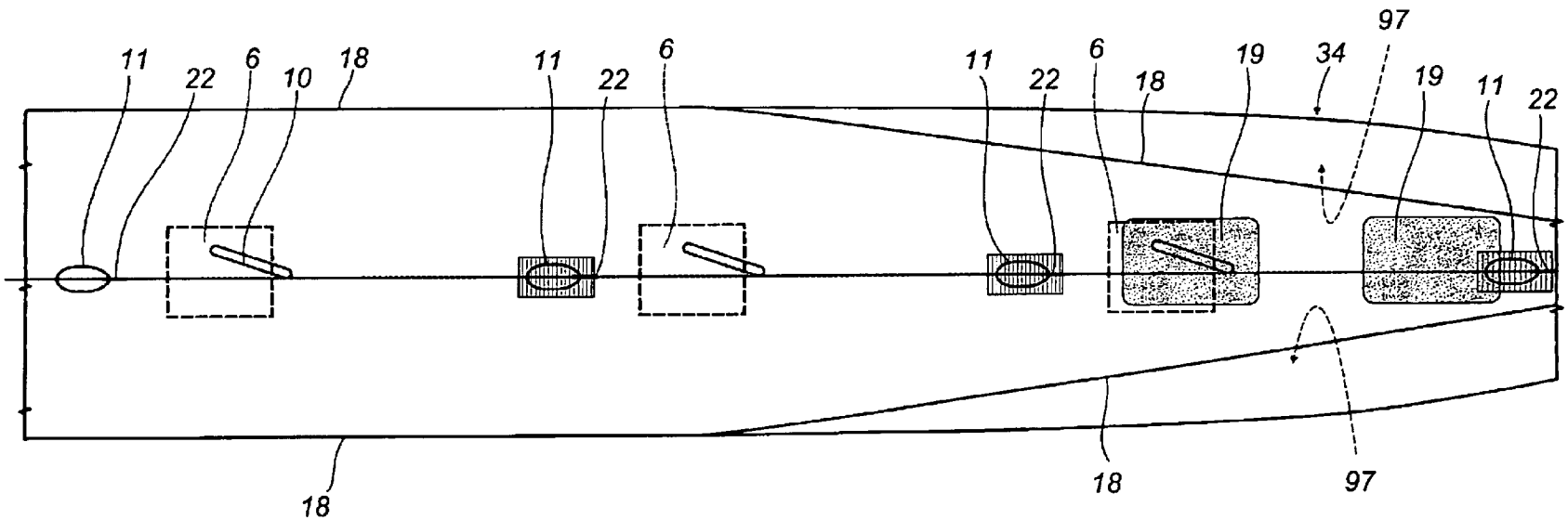
Figure 8:
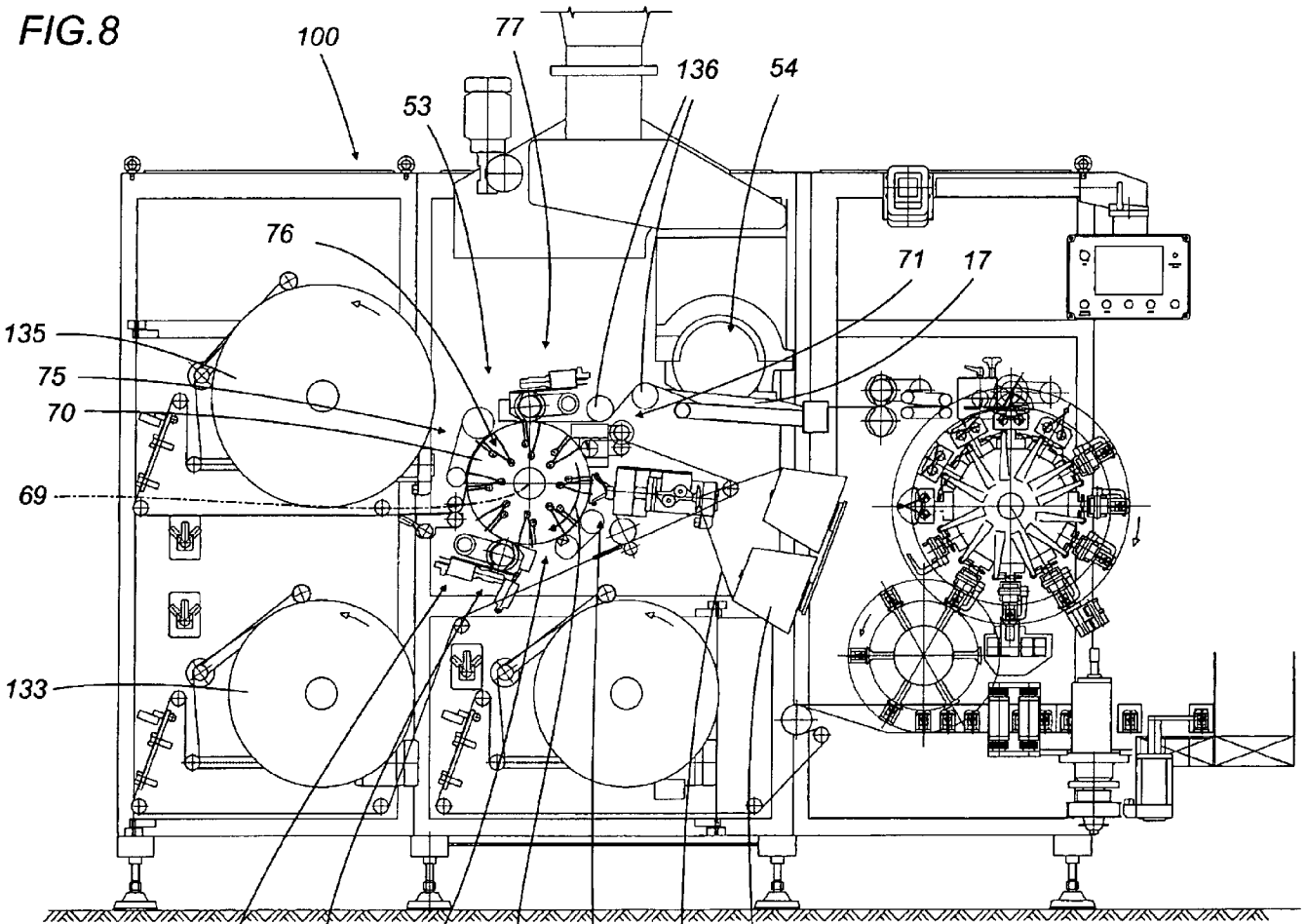
FIG. 8 is a schematic assembly view of the apparatus according to the invention shown in elevation and mounted in an automatic production machine.

In FIGS. 1, 2 and 3 of the accompanying drawings, the numeral 1 denotes in its entirety a filter bag of a type known from patent document IT BO 2002A000013 and essentially comprising: a containment chamber 2 made from heat-sealable paper and comprising two pouches 3 for corresponding charges 19 of the infusion product, the pouches being sealed at a top join 4 and a bottom join 5; a tag 6 for picking up the filter bag 1 and having two flaps 9*a* and 9*b* folded onto each other; and a portion 7 of thread wound around the outside of the containment chamber 2 and extending along an outline of the containment chamber, one end of the thread being connected to the pick-up tag 6 and the other end to the top 15 of the containment filter bag 1. The thread portion 7 is longer than the outline of the containment chamber 2 to which it is attached. The excess length 8 of the thread portion 7 relative to said outline is gathered in the form of first loops 10 on the outside of the chamber 2 containing the infusion product and between the flaps 9*a* and 9*b* of the tag 6. The filter bag 1 is made using a method—also described in patent document IT BO 2002A000013—partially schematized in FIGS. 4 to 7—which comprises the steps of:

forming a row of filter bag 1 pickup-up tags 6 by cutting a web 39 of suitable material at regular intervals (FIG. 4);

feeding a continuous thread 31 above the row of tags 6 to form, above a flap 9*a* of each of the consecutive tags 6, a row of first loops 10 in a thread portion 7 (FIG. 5);

associating the first loops 10 of thread with the tags 6 (FIG. 6);

feeding a web 17 of heat-sealable filter paper over the continuous thread 31 and over the tags 6 connected to it (FIG. 6);

pushing a portion of the thread 31 through the web 17 of filter paper in such a way as to form a second loop 11 projecting from the face of the filter paper web 17 opposite the face adjoining the tags 6 (FIG. 7);

feeding the web 17 of filter paper with the thread 31 and the tags 6 associated with it to a station 54 of a user machine, labeled 100 in its entirety and illustrated as a whole in FIG. 8, where the containment chambers are formed and the charges of infusion product placed in them.

This method is implemented by an apparatus—illustrated in FIG. 8 and labeled 53 in its entirety—for preparing and feeding the filter bag production materials.

Figure 9:
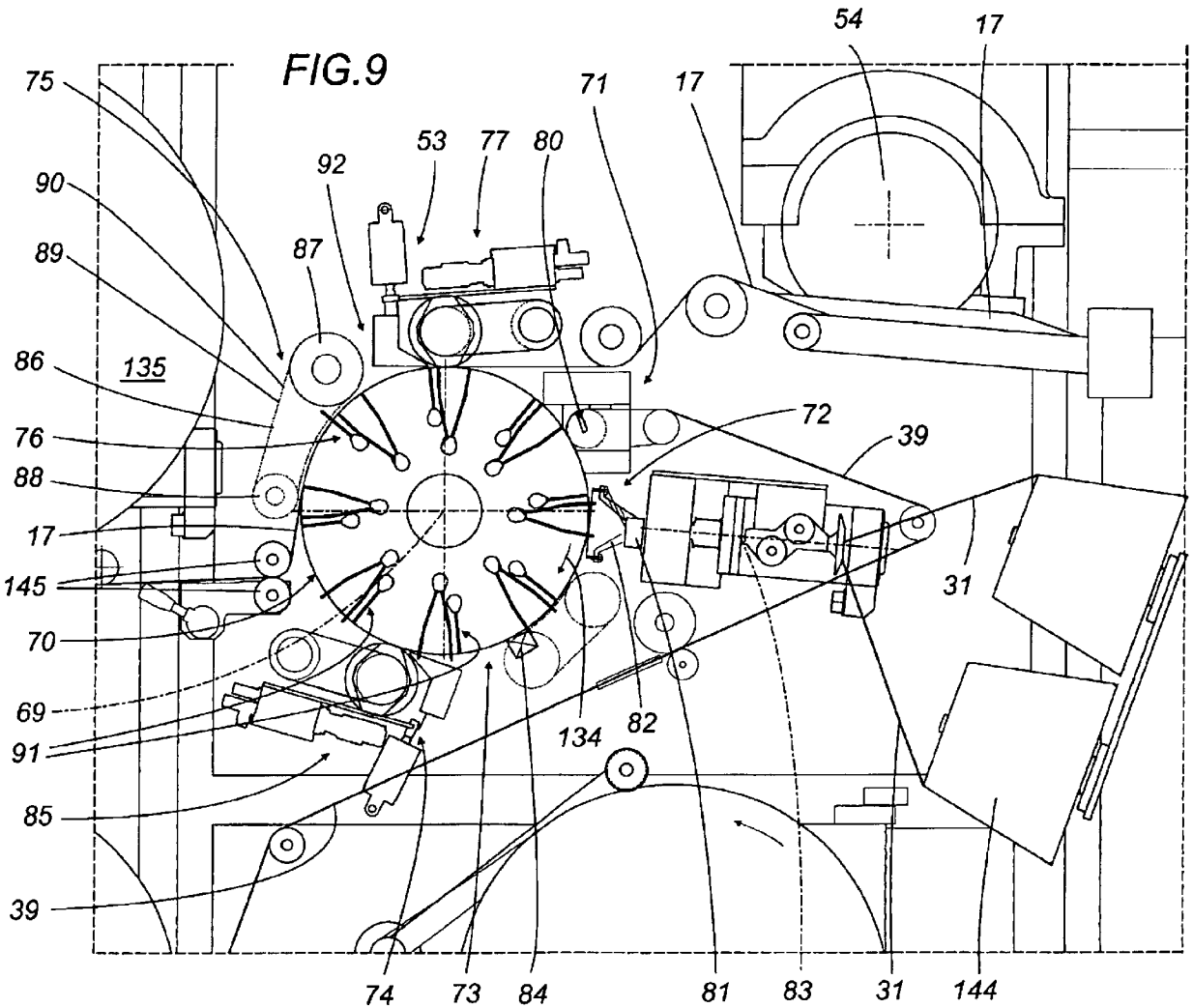
FIG. 9 is a scaled-up assembly view of the apparatus according to the invention.
Figure 10:
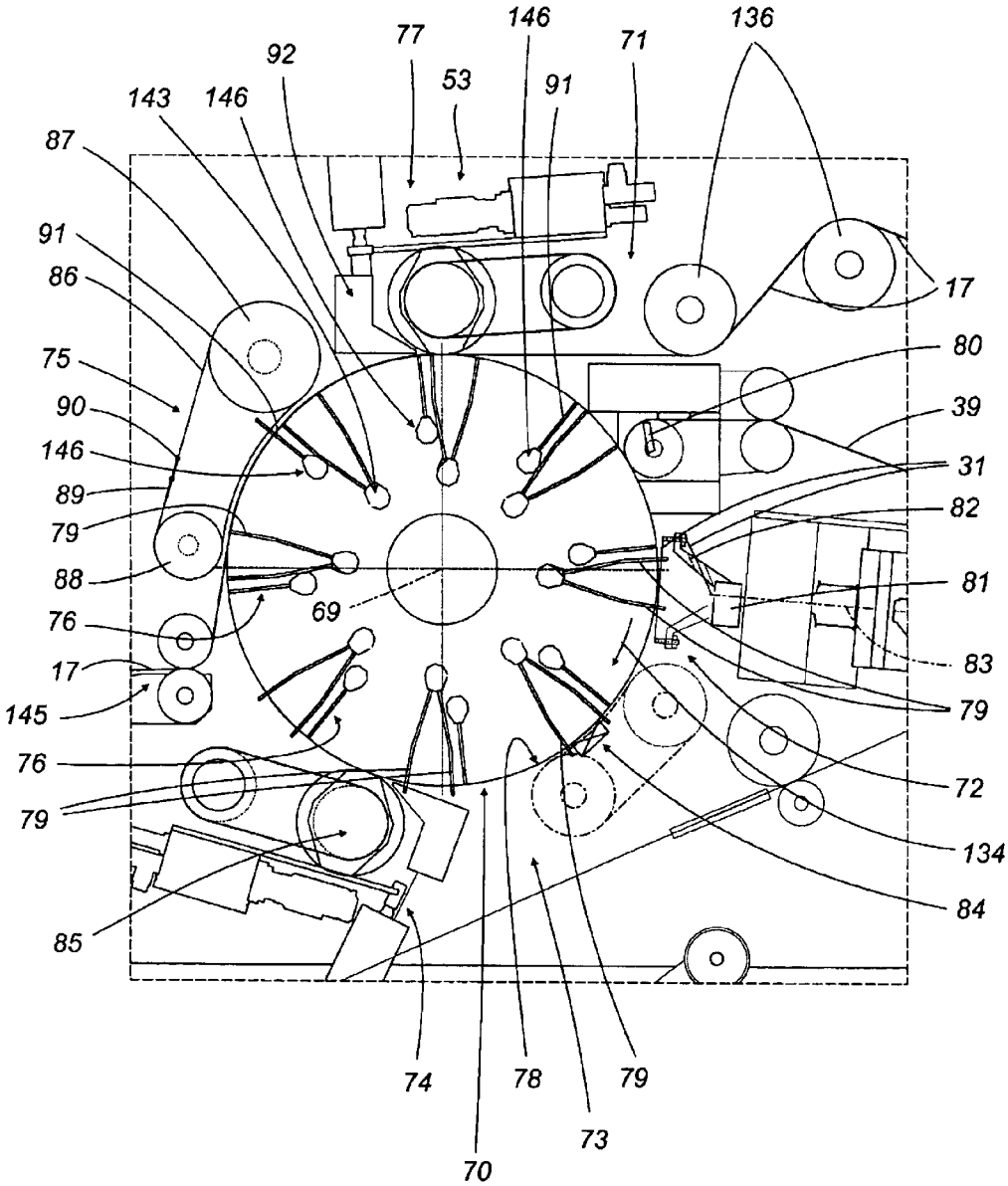
FIG. 10 is a further scaled-up view illustrating in greater detail some parts of the apparatus according to the invention.

The apparatus 53 essentially comprises a power-driven wheel 70 which revolves about a horizontal axis 69 and around which there are arranged a plurality of operating means—better illustrated in FIG. 9 and labeled 71, 72, 73, 74, 75, 76 and 77—following each other in succession around the edge of the wheel 70 according to the latter's direction of rotation indicated by the arrow 134 in the illustration.

The first operator means 71—see also FIG. 9—form the filter bag 1 pick-up tags 6 from a web 39 of suitable material, preferably paper, bearing a layer of glue that can be thermally activated, and arranging them in suitable order around the edge of the revolving wheel 70.

To do this, the first means 71 comprise: a rotary knife 80 mounted near the edge of the revolving wheel 70; and retaining means 78 for holding the tags 6 to the edge of the wheel 70, housed inside the body of the wheel and operating preferably by pneumatic suction. The first means 71 further comprise a series of pegs 79, distributed at regular intervals around the body of the wheel 70 and positioned on each side of the retaining means 78. Under the action of suitable cam drives 143, the pegs 79 periodically extend past the edge of the wheel 70 in such a way as to protrude radially from the latter.

The knife 80 cuts the web 39, which is unwound from a roll 133, into lengths, each of which corresponds to a single tag 6. The lengths are successively captured by the retaining means 78 which attract them to the wheel 70 and place them at regular intervals between the successive pairs of pegs 79, holding them in close contact with the wheel 70 during the latter's full rotation.

The second means 72 comprise a tubular spindle 81, which is rotationally driven about an axis of rotation 83, and which is equipped, at the end of it facing the wheel 70, with an arm 82 that is transversal to the axis of rotation 83 and projects towards the wheel 70. A bobbin 144 feeds the spindle 81 with a continuous thread 31.

As the spindle 81 rotates about its axis 83 in front of a pair of pegs 79 protruding as they pass by on the revolving wheel 70, its arm 82 creates around the pegs 79 the first loops 10 of thread each located at a position corresponding to a pickup tag 6 carried below it by the revolving wheel 70.

Thus, as the thread 31 is unwound from the bobbin 144 by the rotation of the wheel 70, it extends continuously around the edge of the wheel and, in so doing, progressively forms the first thread loops 10 above each of the tags 6 carried by the wheel 70, at the same regular intervals as the tags 6.

The third means 73 comprise a fixed folding element 84, helical in shape and suitably located to intercept a lateral edge of the tag 6 as the latter, moving past as one with the revolving wheel 70, comes into contact with the folding element 84 itself.

For delimiting two contiguous flaps 9*a* and 9*b* on each tag 6, the paper web 39 from which the tags 6 are cut has a fold line 21 running lengthwise along the middle of the web 39, and thus, when a tag 6 strikes the fixed helical folder element 84, one of its flaps 9*a* is gradually rotated about the fold line 21 and folded over the other flap 9*b*.

Thus, thanks to the action of the folder 84, the flaps 9*a* and 9*b* of the tags 6 are folded onto each other, while the first thread loops 10, still held by the pegs 79, are enclosed between the flaps 9*a* and 9*b*.

The fourth means 74 comprise a first heating device 85 associated with the outer edge of the wheel 70 and designed to thermally activate the layer of glue on the tags 6.

Consequently, as the wheel 70 rotates, the tags 6 interact with the heater 85 and are pressed against the wheel behind them in such a way that the flaps 9*a*, 9*b* of the tags 6 are joined together and the first thread loops 10 securely held between them.

The fifth means 75 comprise a looped flexible element 86 that is trained around a pair of pulleys 87, 88, at least one of which is power driven, and that lies against a peripheral portion of the wheel 70. The flexible element 86 is embodied preferably, but not exclusively, as a stainless steel chain whose links 89 and pins 90 do not require lubrication.

A web 17 of filter paper bearing a layer of glue to be thermally activated is unwound from a roll 135 and, after moving through a feed element 145 is fed tightly between the flexible element 86 and the edge of the wheel 70 over the continuous thread 31 and the tags 6 connected to it.

The coordinated drive of the flexible element 86 and of the wheel 70 thus causes the filter paper web 17, the continuous thread 31 and the tags 6 to move together as one in well-defined positions relative to each other.

The sixth means 76, associated with the revolving wheel 70, comprise needles 91 which are housed in the body of the wheel 70 and which are driven by actuating cam elements 146 in a radial direction relative to the wheel 70 and synchronized with it. The needles 91 are made to rhythmically protrude from the edge of the wheel 70 towards, and in synchrony with, the flexible element 86 which is pressing the filter paper web 17 in such a way that the needles 91 go through the links 89 of the chain without hitting the chain link pins 90. As the needles 91 move, they strike the continuous thread 31 lying on the edge of the wheel 70 and push the thread 31 through the filter paper web 17 to the opposite face of the filter paper web 17 adjacent to the flexible element 86.

This creates second loops 11 on the thread 31 which extend outwards from the wheel 70 and lie on the face of the filter paper web 17 opposite the face against which the tags 6 are lying.

To reduce wear on the needles 91, the filter paper web 17 coming off the roll 135 might have ready-made incisions or slits in it at regular intervals so as to facilitate the passage of the needles 91 through the filter paper web 17, Alternatively, a filter paper web 17 without incisions might be used and, instead, the wheel 70 might be equipped with suitable means designed to make the incisions 22 in the filter paper web 17 just before the needles 91 are pushed through it.

The seventh means 77 next encountered by the filter paper web 17 and the thread 31, now mutually interacting and joined to each other as they move forward in parallel, comprise a second heating device 92, associated with the edge of the revolving wheel 70.

This heating device 92 thermally activates the layer of glue on the filter paper web 17 in a limited area around each of the second loops 11 as they move past. At the same time, the heating device 92 also acts on the underlying tag 6 and thermally activates the glue on an edge 37 of the tag 6 facing the opposite face of the filter paper web 17.

Thus, the operation of the seventh means 77 simultaneously activates the glue on the filter paper web 17 and on the tags 6, thus causing the filter paper web 17 to be attached to the second thread loops 11 and to the tags 6.

When the filter paper web 17 leaves the heating device 92, it moves away from the revolving wheel 70 and the second thread loops 11 are by that time attached to one side of the filter paper web 17 and the continuous thread 31 attached to the other side of it at the tags 6. The first loops 10 of the thread 31 are gathered and held securely between the tag flaps 9*a* and 9*b*.

It should be noticed that the structure of the apparatus as described above for preparing and feeding the filter bag materials enables the wheel 70 to revolve continuously with, also moving continuously around it, all the filter bag materials, namely: the thread 31, the tags 6 and the filter paper web 17.

It should also be noticed that the few reciprocating movements—which, as is well known in the trade, usually slow down machine operation—regard, in the apparatus according to the invention, only the pegs 79 and the needles 91 which are very light weight and which perform very small movements during the rotation of the wheel 70 which is practically unaffected by them.

This means that the apparatus 53 for preparing and feeding the filter bag materials can operate at very high speeds, significantly contributing to the high performance of the machine 100.

It will be understood that the invention described may be useful in many industrial applications and may be modified and adapted in several ways without thereby departing from the scope of the inventive concept. Moreover, all the details of the invention may be substituted by technically equivalent elements.

What is claimed is:

1. An apparatus for preparing and feeding materials used to make a filter bag (1) to contain an infusion product, the apparatus comprising the following arranged in succession around the edge of a power-driven revolving wheel (70):

first means (71) for forming filter bag (1) pick-up tags (6) from a web (39) of suitable material and arranging them in suitable order around the edge of the revolving wheel (70);

second means (72) for feeding a continuous thread (31) and forming in it first loops (10) at regular intervals from each other at positions corresponding to the pick-up tags (6) carried by the revolving wheel (70);

third means (73) acting on the tags (6) for delimiting separate faces (9*a*, 9*b*) on each tag (6) and folding these faces (9*a*, 9*b*) onto each other in such a way that the first loops (10) of thread are held between the faces (9*a*, 9*b*) of the tags (6);

fourth means (74) for joining the faces (9*a*, 9*b*) of each tag (6) to each other;

fifth means (75) for associating a web (17) of filter paper to the edge of the revolving wheel (70) and positioning it above the continuous thread (31) and the tags (6) connected to it;

sixth means (76) associated with the revolving wheel (70) for pushing a portion (7) of the continuous thread stretched on the edge of the wheel (70) through the web (17) of filter paper in such a way as to form a second loop (11) extending outwards from the wheel (70) and protruding from a face of the filter paper web (17) opposite the face adjoining the tags (6).

2. The apparatus according to claim 1, where the filter paper web (17) has a layer of glue which can be thermally activated, further comprising seventh means (77) for attaching the second thread loops (11) and the tags (6) to the filter paper web (17).

3. The apparatus according to claim 1, wherein the first means (71) for forming the tags (6) comprise: a rotary knife (80) mounted near the edge of the revolving wheel (70), designed to cut a web (39) of suitable material into lengths, each corresponding to an individual tag (6); retaining means (78) for holding the tags (6) to the edge of the wheel (70); and pegs (79) projecting outwards from the edge of the wheel (70), the pegs (79) being located on each side of the retaining means (78) and acting in combination with the latter in such a way as to place the tags (6) at predetermined positions around the edge of the wheel (70).

4. The apparatus according to claim 1, wherein the second means (72) for feeding the continuous thread (31) comprise a tubular spindle (81), equipped with an arm (82) projecting towards the wheel (70) and transversal to the axis of rotation (83) of the spindle (81), the spindle (81) supplying the arm (82) with a continuous thread (31) and rotating the arm (82) in synchrony with the rotation of the wheel (70) in such a way as to wind at least one first loop (10) of thread around the pegs (79) protruding from the wheel edge, each first thread loop (10) being placed on a tag (6) located between the pegs (79).

5. The apparatus according to claim 1, where the tag (6) has two adjacent faces (9*a*, 9*b*) delimited by a central fold line (21), wherein the third means (73) for delimiting the separate faces (9*a*, 9*b*) of the tags (6) comprise a fixed folding element (84) associated with the edge of the revolving wheel (70) and designed to intercept a lateral edge of the tag (6) as the latter moves past as one with the revolving wheel (70), the fixed folding element (84) gradually folding one face (9*b*) of the tag (6) onto the other face (9*a*) in such a way as to hold the first thread loops (10) between the faces (9*a*,9*b*).

6. The apparatus according to claim 1, where the web (39) of tag (6) material has a layer of glue which can be thermally activated, wherein the fourth means (74) for joining the faces (9*a*, 9*b*) of each tag (6) to each other comprise a first heating device (85) associated with the outer edge of the revolving wheel (70) and located downstream of the third means (73) in the direction of rotation of the revolving wheel (70).

7. The apparatus according to claim 1, wherein the fifth means (75) comprise a flexible element (86) trained around a pair of pulleys (87, 88), at least one of which is power driven, the flexible element (86) lying against a peripheral portion of the wheel (70) and pressing the filter paper web (17) against the wheel (70) causing it to move forward together with the wheel (70).

8. The apparatus according to claim 7, wherein the flexible element (86) comprises a chain having links (89) and pins (90) which flexibly connect the links (89).

9. The apparatus according to claim 1, wherein the sixth means (76) comprise a needle (91) housed inside the wheel (70) and driven by actuating elements in synchrony with it, the needle (91) being designed: to rhythmically protrude from the edge of the wheel (70); to strike the continuous thread (31); and to push the thread (31) through the filter paper web (17) to the opposite face of the filter paper web (17) adjacent to the flexible element (86).

10. The apparatus according to claim 9, wherein the needle (91) and the flexible element (86) are synchronized with each other in such a way that the needle (91) is driven through the chain at the links (89).

11. The apparatus according to claim 2, wherein the seventh means (77) for joining the filter paper web (17), the second loops (11) of thread (31) and the tags (6) comprise a second heating device (92), which is associated with the edge of the revolving wheel (70) and which thermally reactivates the layer of glue on the filter paper web (17) at an area around the second loop (11) and a layer of glue on an edge (38) of the underlying tag (6) facing the opposite face of the filter paper web (17), the second heating device (92) being designed to join one side of the filter paper web (17) to the second loop (11) and the other side of it to the tag (6).

12. The apparatus according to claim 9, further comprising means for making incisions or slits (22), at regular intervals on the filter paper web (17), in order to make it easier for the needle (91) to move through the filter paper web (17) to form the second loop (11).

13. The apparatus according to claim 2, wherein the fifth means (75) comprise a flexible element (86) trained around a pair of pulleys (87, 88), at least one of which is power driven, the flexible element (86) lying against a peripheral portion of the wheel (70) and pressing the filter paper web (17) against the wheel (70) causing it to move forward together with the wheel (70).

14. The apparatus according to claim 3, wherein the fifth means (75) comprise a flexible element (86) trained around a pair of pulleys (87, 88), at least one of which is power driven, the flexible element (86) lying against a peripheral portion of the wheel (70) and pressing the filter paper web (17) against the wheel (70) causing it to move forward together with the wheel (70).

15. The apparatus according to claim 4, wherein the fifth means (75) comprise a flexible element (86) trained around a pair of pulleys (87, 88), at least one of which is power driven, the flexible element (86) lying against a peripheral portion of the wheel (70) and pressing the filter paper web (17) against the wheel (70) causing it to move forward together with the wheel (70).

16. The apparatus according to claim 5, wherein the fifth means (75) comprise a flexible element (86) trained around a pair of pulleys (87, 88), at least one of which is power driven, the flexible element (86) lying against a peripheral portion of the wheel (70) and pressing the filter paper web (17) against the wheel (70) causing it to move forward together with the wheel (70).

17. The apparatus according to claim 6, wherein the fifth means (75) comprise a flexible element (86) trained around a pair of pulleys (87, 88), at least one of which is power driven, the flexible element (86) lying against a peripheral portion of the wheel (70) and pressing the filter paper web (17) against the wheel (70) causing it to move forward together with the wheel (70).

* * * * *